United States Patent [19]

Zeiss

[11] Patent Number: 4,731,039

[45] Date of Patent: Mar. 15, 1988

[54] FLOATS TO BE USED PAIRWISE TO WALK ON WATER

[76] Inventor: Karl R. Zeiss, Gilgenmatten 1, D-7800 Freiburg, Fed. Rep. of Germany

[21] Appl. No.: 906,963

[22] PCT Filed: May 12, 1984

[86] PCT No.: PCT/DE84/00108

§ 371 Date: Jan. 18, 1985

§ 102(e) Date: Jan. 18, 1985

[87] PCT Pub. No.: WO84/04694

PCT Pub. Date: Dec. 6, 1984

Related U.S. Application Data

[63] Continuation of Ser. No. 704,319, Jan. 18, 1985, abandoned.

[30] Foreign Application Priority Data

May 20, 1983 [DE] Fed. Rep. of Germany ..... 3318384

[51] Int. Cl.[4] ..... A63C 15/03

[52] U.S. Cl. ..... 441/76; 441/77

[58] Field of Search ..... 441/65, 70, 76, 77, 441/78, 79

[56] References Cited

U.S. PATENT DOCUMENTS

| | | | |
|---|---|---|---|
| 1,693,867 | 12/1928 | Reinwald | 441/76 |
| 3,566,427 | 3/1971 | Davis et al. | 441/76 |
| 3,833,956 | 9/1974 | Meehan | 441/76 |
| 3,835,494 | 9/1974 | Dougherty | 441/77 |
| 4,296,511 | 10/1981 | Wright | 441/79 X |

FOREIGN PATENT DOCUMENTS

| | | | |
|---|---|---|---|
| 194765 | 1/1958 | Austria | 441/79 |

*Primary Examiner*—Joseph F. Peters, Jr.
*Assistant Examiner*—Paul E. Salmon
*Attorney, Agent, or Firm*—Larson and Taylor

[57] ABSTRACT

An elongate float to walk on water with another such float is provided with a foot holder. The foot holder is mounted in a transverse direction such that the buoyancy force on the inside edge of the float relative to the other float is greater than the buoyancy force on the outside edge.

10 Claims, 18 Drawing Figures

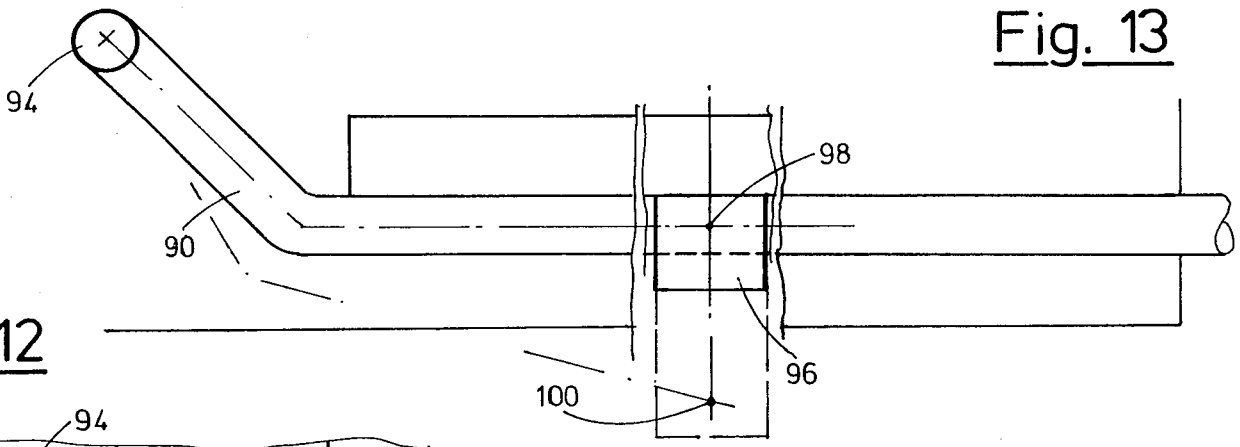
Fig. 13
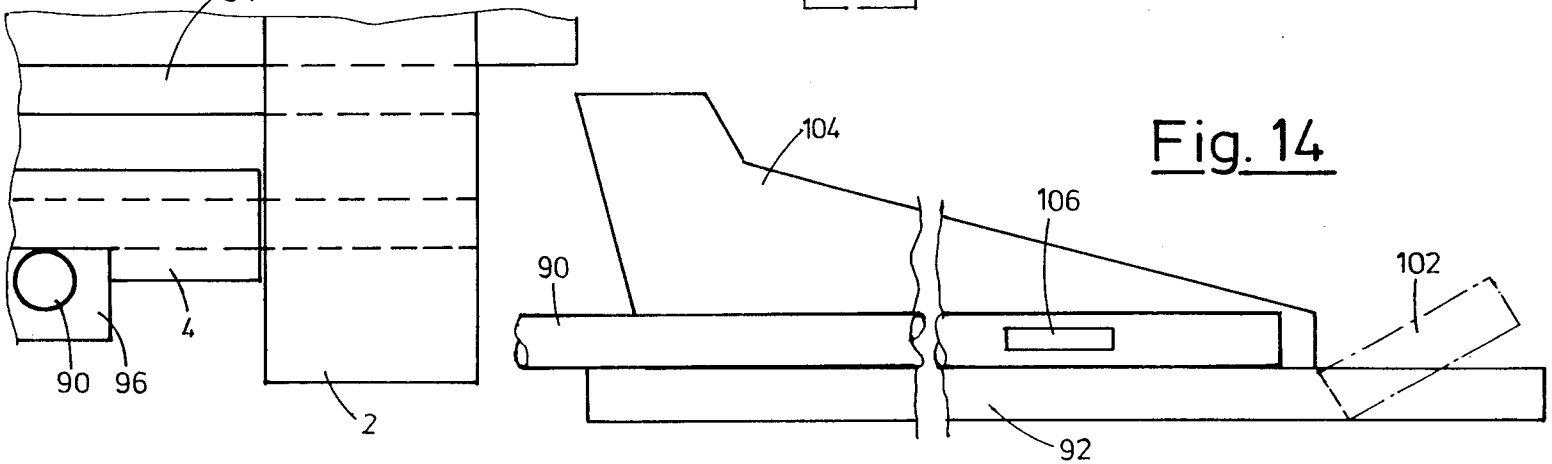
Fig. 14
Fig. 12

FLOATS TO BE USED PAIRWISE TO WALK ON WATER

This application is a continuation of application Ser. No. 704,319 filed Jan. 18, 1985, now abandoned.

FIELD OF THE INVENTION

The invention relates to a pair of floats with a foot holder for one foot on each float, to be used for walking on water.

BACKGROUND OF THE INVENTION

Floats which can hold a person above the water have long been known. They have the drawback, however, that they are quite large and heavy and thus are expensive. Also, it is very difficult for less skilled persons to keep their balance and to propel themselves. Normally they can move only by using rods or sticks.

SUMMARY OF THE INVENTION

The invention however discloses an apparatus for walking on water which allows for better balance and is also an improvement relative to forward movement capacity. The invention is comparable in use and in cost to skis. This object is achieved by the invention in that the arrangement of the foot holder and/or the mass distribution are asymmetrically transverse to the foot holder, so that when the float is loaded the force of buoyancy is greater on the inside edge than on the outside edge.

As small as possible a contact surface for the foot should be aimed for in practice, because that improves the stability. The invention provides for this in all embodiments, especially when hollow cavities are present and are open at the bottom. This allows for a high but narrow construction, which allows walking, somewhat as though on skis.

Several advantages can be attained according to the configuration of the aforementioned cavities. First of all, the air enclosed in the cavity provides buoyancy. A check valve or flap or the like can be formed with a top opening of one particular cavity opening only downward on the inside in connection with a check valve. Thus, even when a vacuum pressure occurs in the hollow cavity during movement, air can flow into the cavity from above through the check flap, but then cannot escape from there upward. The hollow cavities therefore allow the slip resistance to be influenced, as a result of their configuration alone or in combination with guide and/or propulsion members which reach into the water. Normally, one aims only to keep the slippage or flow resistance very slight in forward direction, but it is then much greater in reverse direction. Thus, one foot must be used to propel a float in forward direction, while the float supporting the other foot provides a support to the rear.

The aforementioned cavities could also be configured as nearly but not completely closed on the bottom. Then, the cavity is filled with water during use and this water volume is dragged along and aids in stabilization and improves certain dynamic properties.

In another practical embodiment, hollow cavities can be so configured that water enters at the front and is discharged at the rear during movement. That can be attained by means of flippers or the like. Thus, it is not possible for water to flow through the cavity in the opposite direction, from the rear forward, in the same manner as from the front to the rear.

In one preferred practical embodiment, each float is of a construction essentially similar to that of a catamaran. Both body parts serve as side guides—hereinafter called side guide parts—and also form the sides of one or more hollow cavities. The side guide parts should in turn provide buoyancy and be rather long and high, but narrow, in order to act as side guides to prevent transverse sliding as much as possible.

Both side guide parts are preferably connected by a cover part covering them as well as other connection elements and held at a certain distance. Partitions or inserts which limit the cavities at the front or rear could also serve as connection elements. The front and/or rear surfaces of the partitions and inserts are preferably configured as tilted or provided with bevels to facilitate sliding forward, while a resistance counters the tendency to slide to the rear.

The foot holder also preferably serves as a connection element between the two side guide parts. This member preferably has essentially the shape of a shoe in lengthwise cross section.

In the top area of the float and to the sides of the side guide parts, other side parts of light material aid in further reinforcing the float and improve the stabilization. They can also be covered with hard reinforcement inserts, sheathings or the like.

Independent from the aforementioned measures for production of different degrees of slip resistance forward and rearward, the new float can also be provided with suitable propulsion members. These of course could be powered. Preferred, however, are propulsion elements which are powered either by foot movements or by load shifting. As an exemplary embodiment of this, blade-shaped or skid-shaped propulsion members are used. These are moved by movements of the foot relative to the foot holder, so that a propulsion force is produced. In another practical embodiment, foot movements can be used for operation of a pump device, which forces water to the rear and thus produces a drive.

The preferred material for the new float is closed-cellular soft plastic, but individual parts can also be reinforced or can consist of solid materials. To improve the forward thrust of a person-carrier, any float preferably consists of a plurality of short parts which can be combined into the entire length.

Other preferred embodiments are found in the claims and the following exemplary description.

BRIEF DESCRIPTION OF THE DRAWINGS

FIG. 12 is a section through an exemplary pivot bearing of a propulsion member in the area of the foot holder, FIGS. 13 and 14 complete the sections of the front and rear parts of a propulsion member supported as in FIG. 12 in the form of a reciprocating paddle.

DETAILED DESCRIPTION OF THE PREFERRED EMBODIMENT

Figure 1:
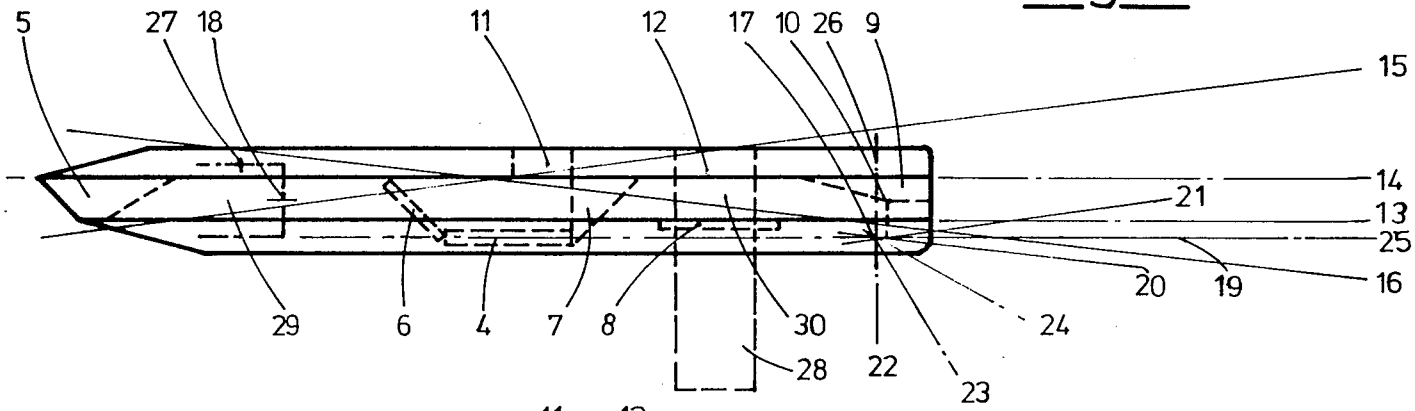
FIG. 1 is a side view of a float according to the invention.
Figure 3:
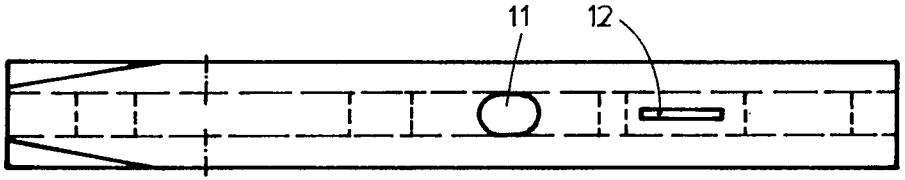
FIG. 3 is a plan view of the float of FIGS. 1 and 2.
Figure 2:
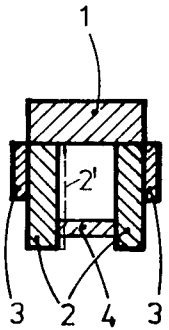
FIG. 2 is a transverse section through the float of FIG. 1.

A preferred exemplary embodiment of a float is shown in FIGS. 1 to 3, wherein the metacenter is especially low. The float includes a top part 1, two side guide parts 2 and side parts 3 arranged on the outside of the top. Side guides 2 are also connected by a foot holder 4, a front inside part 5, an inside deflector 6, an inside guide wedge 7 and a rear inside part 9. A water guide part 8 and a flipper 10 are also provided. A foot aperture 11 is located on top part 1, and behind that is a guide opening 12. The bottom water line 13 is the water line when the float is not loaded, and the top water line 14 is that indicated when the float is loaded. By pivoting movements, which are either desired or are created by water, the float oscillates in the area of the top angle 15 and bottom angle 16 around water line 14. Rear assembly holder 17 and front assembly holder 18 cooperate entirely in these reciprocal movements and also in all other movements of the float. Certain mechanisms, e.g. brake and propulsion members, are mounted there and are to be explained hereinafter. At 17 and 18 are found flipper devices which are pivotable or are mounted in some other manner. Paddles as well as other elements are provided with floats. These paddles are to be of use for the various reciprocal movements, depths of penetration and loads, as well as special movements in order to propel the float forward and to brake it at the rear. In FIG. 1, therefore, 19 is the starting point of a pivot motion, and 20 is its bottom dead center and 21 is its top dead center. Instead of the cited oscillation/pivot, or in addition to this, a paddle is mounted to be able to pivot on the rear assembly 17. Then this paddle, is also indicated in FIG. 1, can take a stationary position as it is held by a stop member in an essentially perpendicular position, braking the movement to the rear. During forward movement, this paddle can take a first oblique position 23 or during more rapid movement can take a second oblique position 24 and finally, with still more rapid forward movement, can take a top position 25.

FIGS. 1 and 3 also show a rear transverse guide tube 26 and a front transverse guide tube 27. A water guide part 28 is shown in broken line setting, and can be configured as a sort of a tongue.

The cited parts 1, 2, 5, 6 limit an inside front cavity 29, which is open only on the bottom in this example. A corresponding rear hollow cavity 30 is defined by parts 1, 2, 7, 9. During use of the float, cavities 29 and 30 which are open at the bottom are partially filled with air and partially filled with water and are thus indicated as water chambers. The enclosed air provides the buoyancy, and the water in cavities 29 and 30 increases the mass moved during the movement and thus has a stabilizing effect.

FIG. 2, as compared with FIG. 1, shows the lower position of foot holder 4. It also shows that the side guide parts 2 have several functions. They slide with their bottoms in the water and prevent side drift, thus serving simultaneously to provide buoyancy and to improve the buoyancy because they hold air in the tops of cavities 29 and 30.

The foot holder is located somewhat to the outside, so that the float is asymmetrical in transverse direction when loaded. Indeed, when carrying a person the float is higher (out of the water) on the inside edges than on the outside edges. The same effect could also be attained by use of different materials having different buoyancies for side guide parts 2 or side parts 3 on respective sides. To illustrate the arrangement wherein the greater buoyancy between the foot holder and the inside edge is greater in size than the distance between the foot holder and the outer edge, FIGS. 2 and 4 illustrate in dotted lines an enlargement of the left side of these figures with enlarged top part 1′ and side part 2′, which enlargement assumes that the float is the right float and the transverse section is looking toward the front of the float.

Starting from the exemplary embodiment which is shown, cavities/water chambers 29 and 30 could be further opened or closed on the bottom. The mass moment of inertia and stability of the float can thus be influenced during walking.

The plan view of FIG. 3 shows foot insert aperture 11 configured so that the foot can slide easily in and out. Suitable footwear can also be used.

Figure 4:
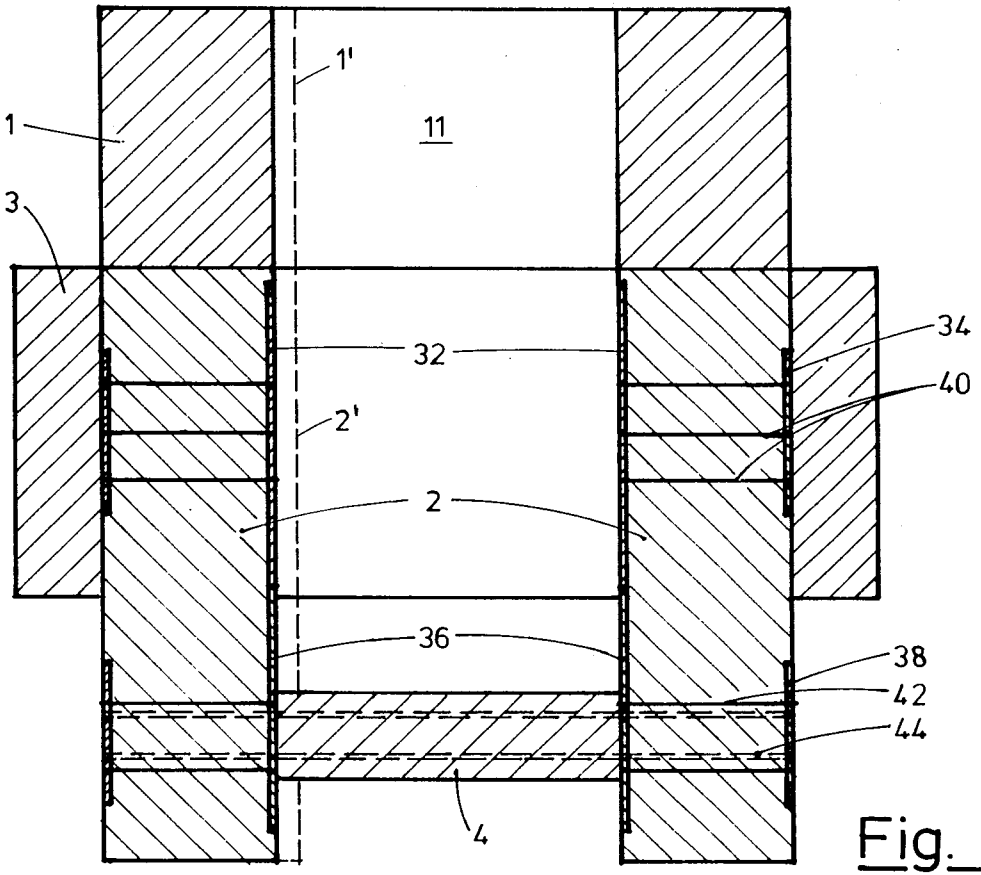
FIG. 4 is another transverse section through a float in larger scale.

FIG. 4 is another larger scale depiction of a transverse section through an exemplary float. As in FIGS. 1 and 2, this consists of a top part 1, two side guides 2 and two side parts 3. The foot holder is again 4 and its aperture is 11.

As a special feature, FIG. 4 shows a top inside sheathing 32 and a top outside sheathing 34 as well as a bottom inside sheathing 36 and a bottom outside sheathing 38 on side guide parts 2. Top outside sheathings 34 are in turn covered by side parts 3. The opposite side guide parts on a float could be guyed or braced by opposite sheathing parts 40 and 42 and thus, with use of compressible materials for the side guide parts 2 in conjunction with sheathings 32, 34, 36, and 38, could produce a strengthening pressure. In addition, a guide holder tube 44 which extends through both side guide parts 2 connects these and can serve to position other parts, e.g. the propulsion member or the foot holder.

Figure 5:
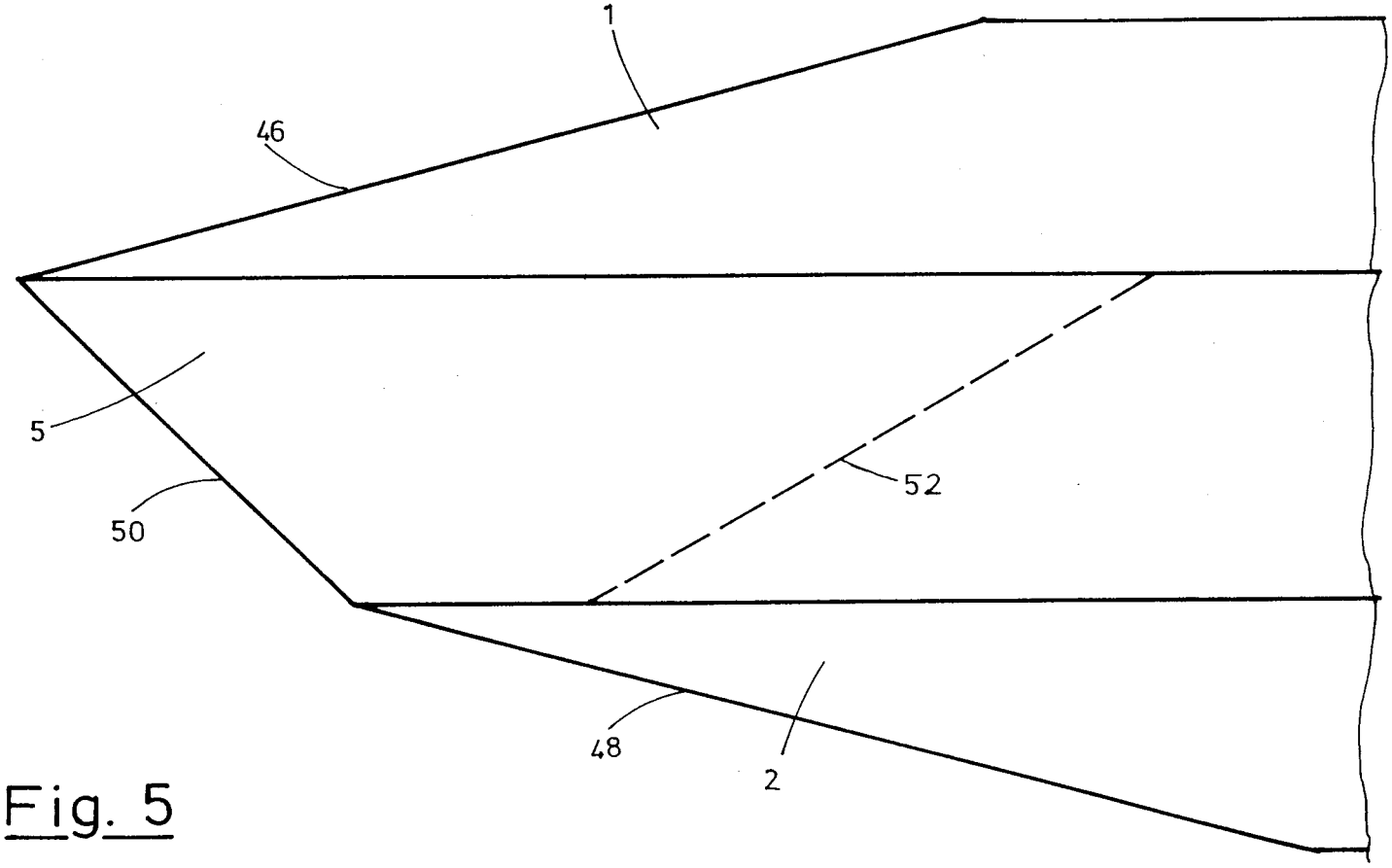
FIG. 5 is a primary drawing corresponding to a side view or a lengthwise section of the construction of the front part of a float.

FIG. 5 shows the front part of the float of FIG. 1 in detail and depicts how satisfactory water control is carried out by the outside and inside bevels. In the example, top part 1 is provided with a top bevel 46 and each side guide part has a bottom bevel 48. The front inside part 5 has an outside bevel 50 and an inside bevel 52. The parts in continuous contact with the water can be finished on the surface to reduce power losses. The surfaces could also be coated with a lubricant which is compatible with the environment and which decreases sticking and friction, as used in skiing.

Figure 6:
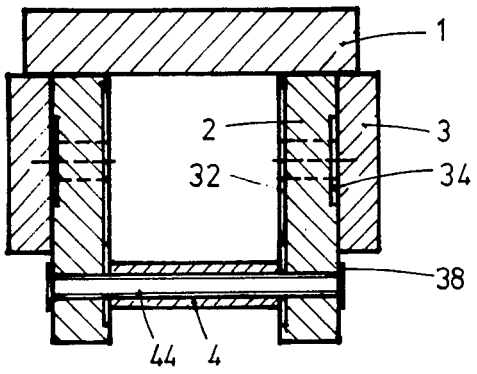
FIG. 6 is another transverse section through an exemplary float.

FIG. 6 shows another section through an exemplary float. This especially shows the removable and adjustable foot holder.

Figure 7:
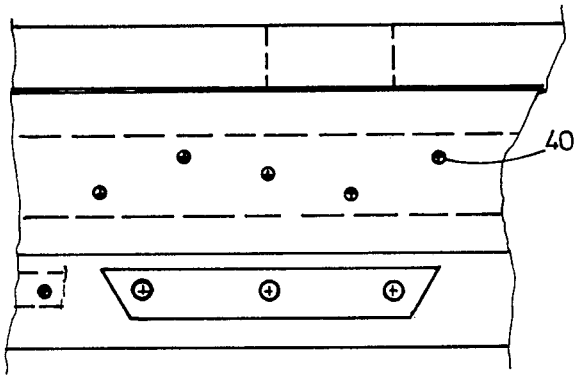
FIG. 7 is a side view of the middle part of a float.

FIG. 7 shows a side view of the middle part of the float shown in transverse section in FIG. 6. This shows how the foot mount is fastened and can be adjusted with a simple peg device. The foot holder can be brought into any desired position by arrangement of the frame bores in various positions.

The position of the sheathing in the example is also emphasized in comparison with FIG. 6. The outside sheathing 34 of FIGS. 4 and 6 is covered by side parts 3, so that there is no danger from hard, projecting non-flexible parts.

Figure 8:
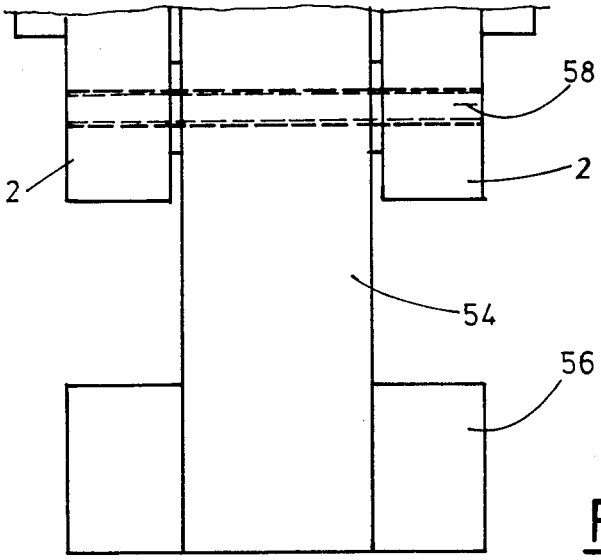
FIG. 8 is a freely pivotably supported blade in front view, working as a reverse brake.
Figure 9:
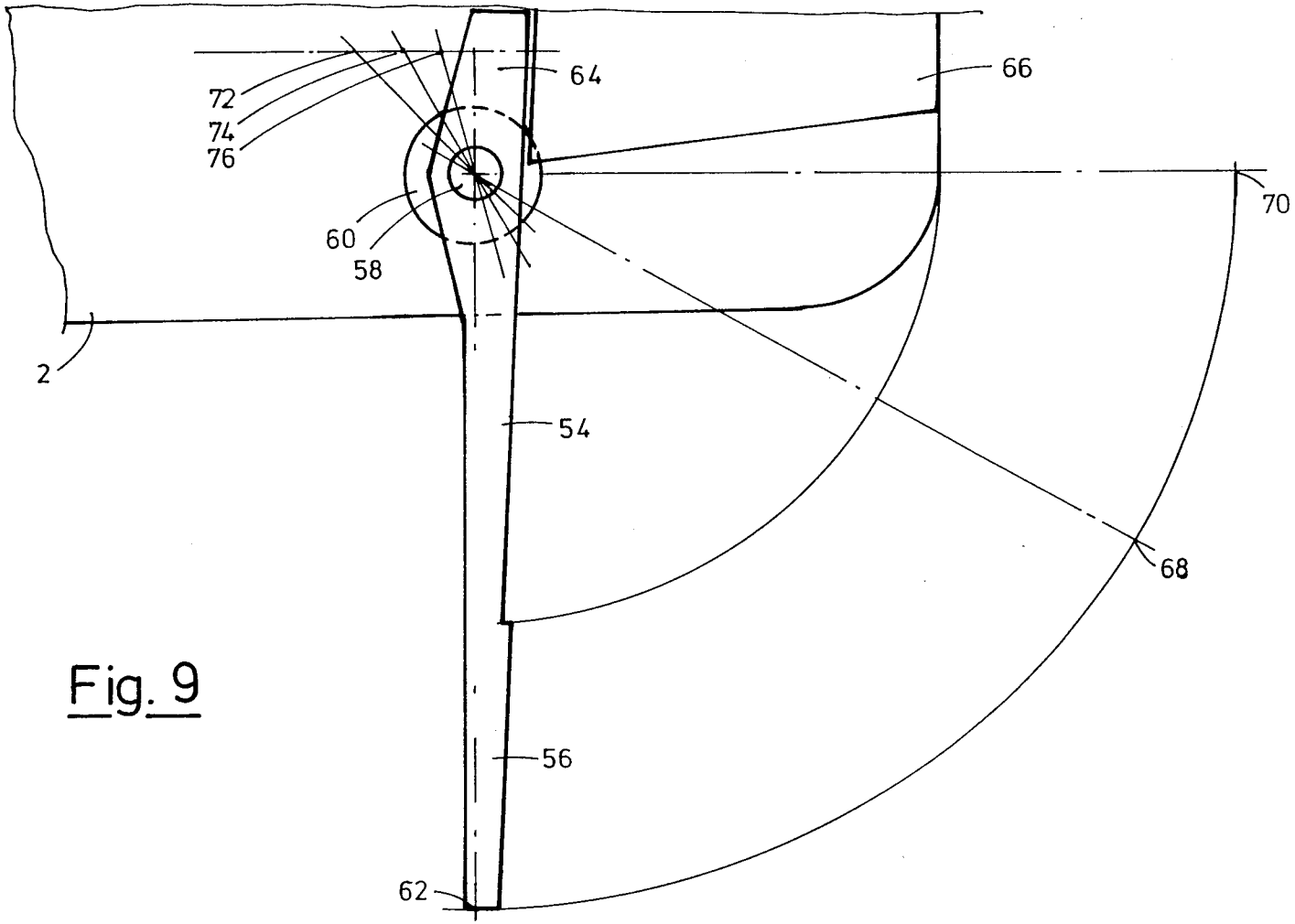
FIG. 9 is the blade of FIG. 8 in side view.

FIGS. 8 and 9 show front and side views of a pivotably mounted paddle serving as a drive mechanism, mounted to pivot between side guide parts 2. This drawing however is in no way limiting. This part could also be indicated as flippers or blades. In the example it is divided into a guide blade 54 and a large paddle 56 on its free end. The flipper is pivotably mounted as a whole on a guide tube 58 with use of spacers 60.

When there is no forward movement on the water, the flipper shown in FIG. 9 takes an essentially perpendicular position 62. If reverse movement is introduced by the foot, then the top arm 64 of the flipper presses against a block 66. Thus, the flipper is held rigidly in position 62 and provides guide blade 54 and large paddle 56 great resistance to the water. The user can use this for support during forward movement of the other foot with the other float.

As soon as the float is moved forward over the water at a certain speed with the flipper, the paddle swings even at low speed into position 68 and at higher speed into position 70. When the movement slows again, the paddle is moved back into position 62 by its own weight, so that another forward movement can take place with renewed foot movements.

For optimization of the system, guide blade 54 and/or large paddle 56 could consist of several blade parts all of which could be connected with the other parts, and have a certain shape. In the exemplary embodiment which is shown, for simplification, flippers 54, 56, 64 are shown as a whole in a rigid element which is essentially U-shaped. Guide tube 58, on which the flipper is mounted, as in FIG. 9, extends through the side cross-pieces. The flipper of course can be provided with additional weights or float elements, so that various desired positions can be taken according to movement conditions. Also, the flipper can be preset in a certain position by a spring.

72, 74 and 76 are intermediate positions.

Figure 10:
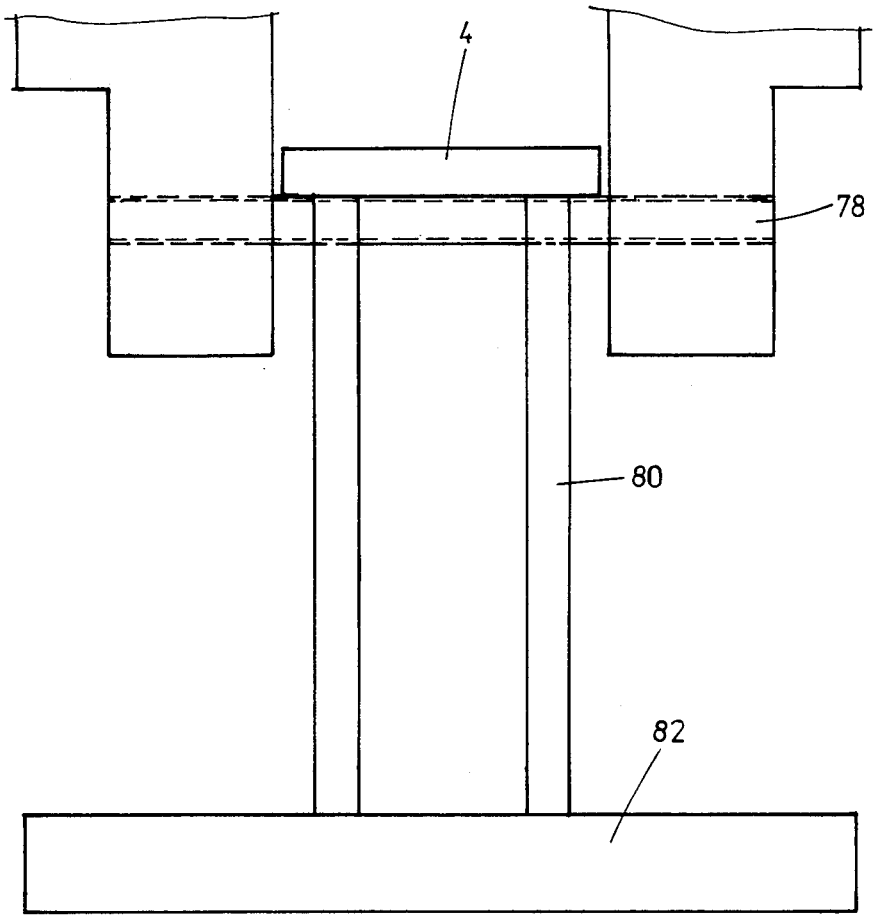
FIG. 10 is a front view of a propulsion blade to be moved randomly by foot movement.
Figure 11:
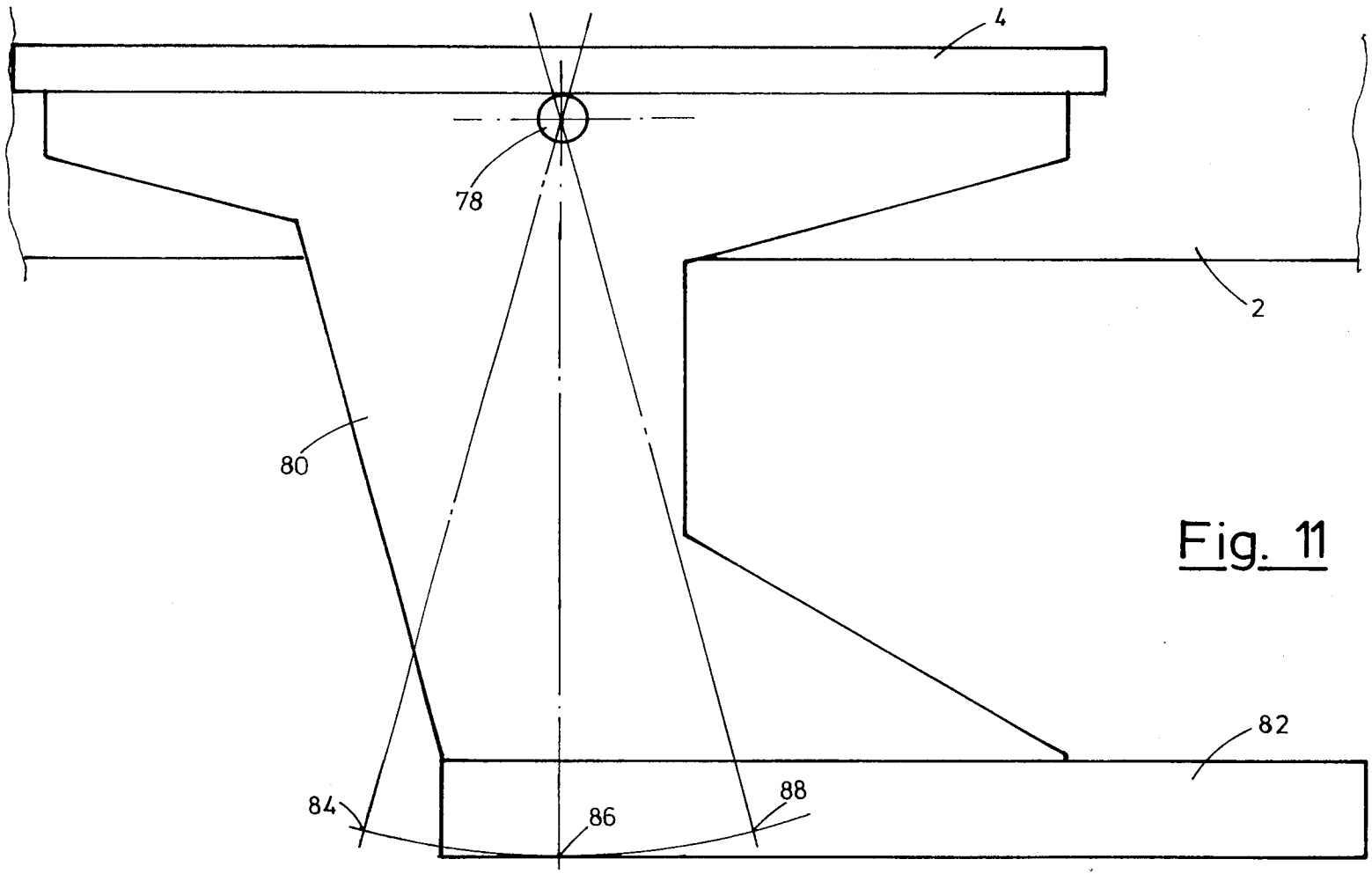
FIG. 11 is the blade of FIG. 10 in side view.
Figure 15:
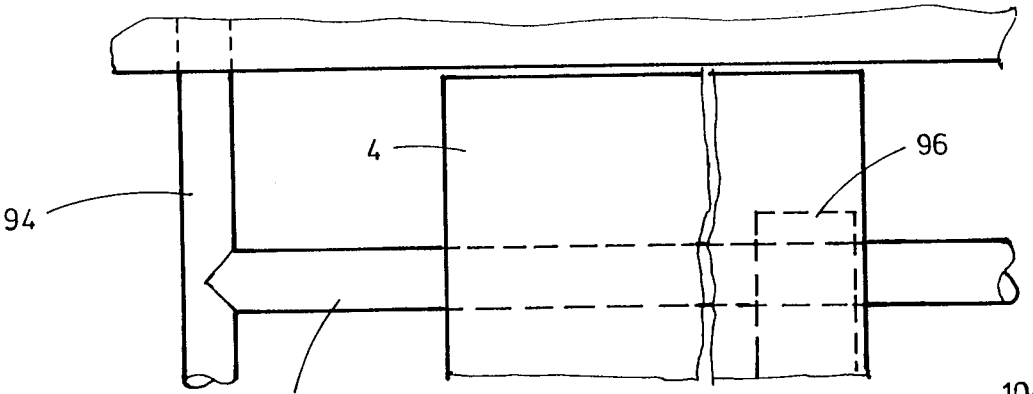
FIGS. 15 and 16 are the plan views corresponding to FIGS. 13 and 14.

FIGS. 10 and 11 are front and side views of a pivoting propulsion paddle actuated with the foot. This pivoting paddle can pivot on a guide tube 78 extending between side guide parts 2 and connected tightly with the plate-shaped foot holder 4. Arms 80 extend out to the sides from this, downward to paddle 82. The angular movements of the foot in this case are magnified by arms 80 and produce an effective paddle movement. Paddle 82 pivots according to the foot movement from position 84 through position 86 to position 88. A satisfactory propulsion is guaranteed with rapid reverse movement and slow forward movement of the paddle.

FIG. 11 is an especially good depiction of the pivot point of the paddle directly below the straining foot. In the middle position 86 which is shown, the propulsion surface of paddle 82 lies essentially horizontal. The paddle can also be configured to be flexible or articulated. The loading requirement for the user is raised or lowered according to the distance of paddle 82 from bearing 78.

Another embodiment of a drive is shown in FIGS. 12 to 16. FIG. 12 shows a transverse section in the area of the foot holder, and FIGS. 13 and 14 are to be viewed as arranged horizontal to each other. A side view of FIGS. 15 and 16 which are likewise horizontal to each other, includes a plan view of a paddle 92 mounted on a rocker arm 90 extending essentially horizontally. Rocker arm 90 is bent upward at the front end in the front of the foot holder and is pivotably mounted by means of guide tube 94, which extends between side guide parts 2. On the basis of inflow technique, the rocker arm 90 is mounted concentrically in the float. It extends from its bearing at 94 outward to the rear beneath foot holder 4. Near the heel of the foot it is provided with an aperture through which a lifting element 96 connected with rocker arm 90 reaches to the foot. Pressure from the foot loads the rocker arm and it can thus be moved. With this arrangement, with alternating loading and unloading of a drive element by the foot, rocker arm 90 with paddle 92 are also alternately loaded and unloaded and thus are moved. Rocker arm 90 of FIG. 13 is brought by the pressure of the foot from the position 98 into the position 100.

Figure 16:
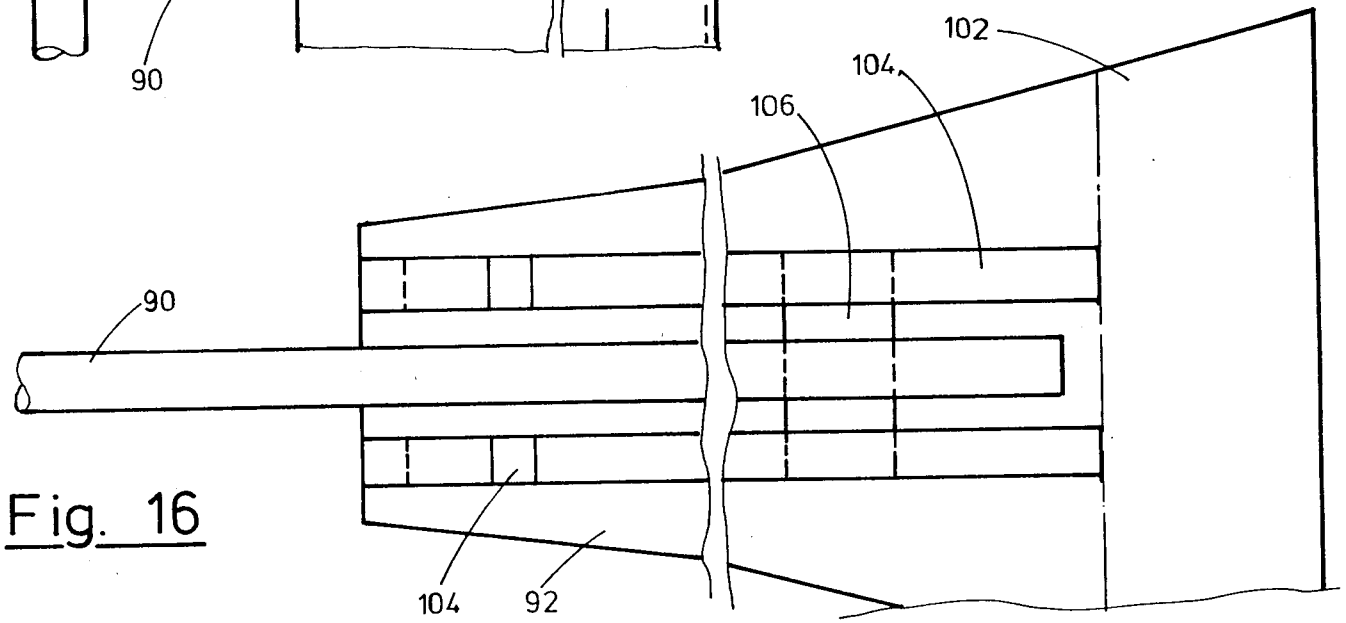

FIGS. 14 and 16 show the paddle at the rear of rocker arm 90 in a side view and a plan view. This shows that an additional paddle 102 can be mounted to pivot to the rear of paddle 92. Also, paddle 92 is provided with perpendicular ribs 104 as side guide device. Paddle 92 is connected with the rocker arm by means of a wedge 106.

Figure 17:
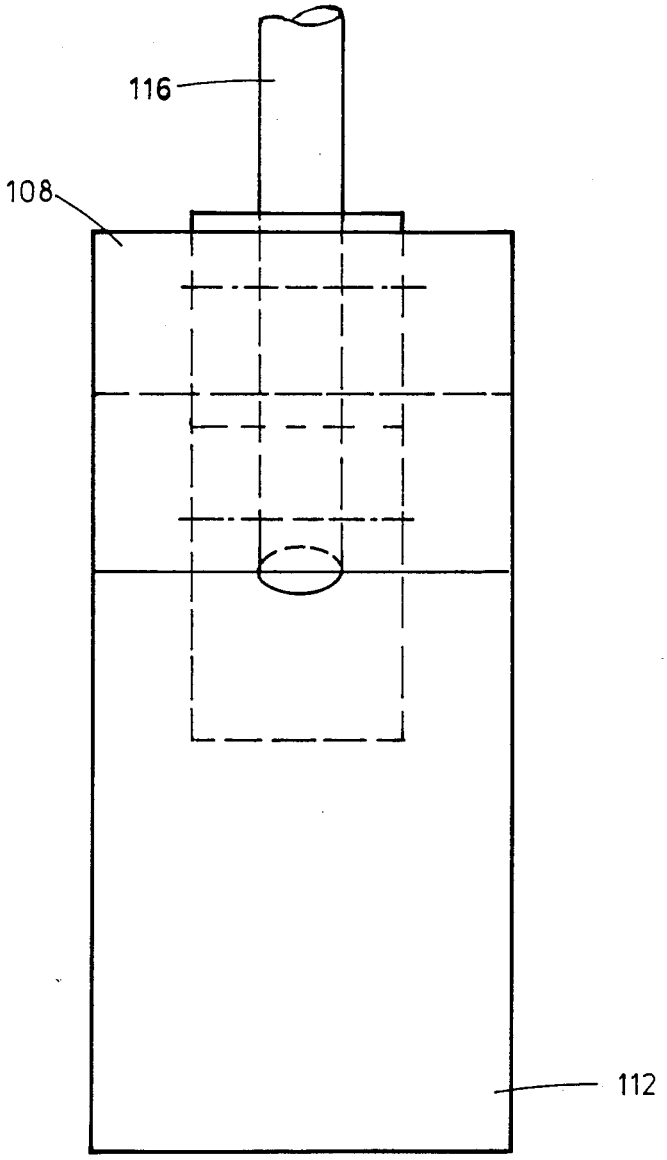
FIG. 17 is the special configuration of a propulsion paddle which can be powered manually or by foot.
Figure 18:
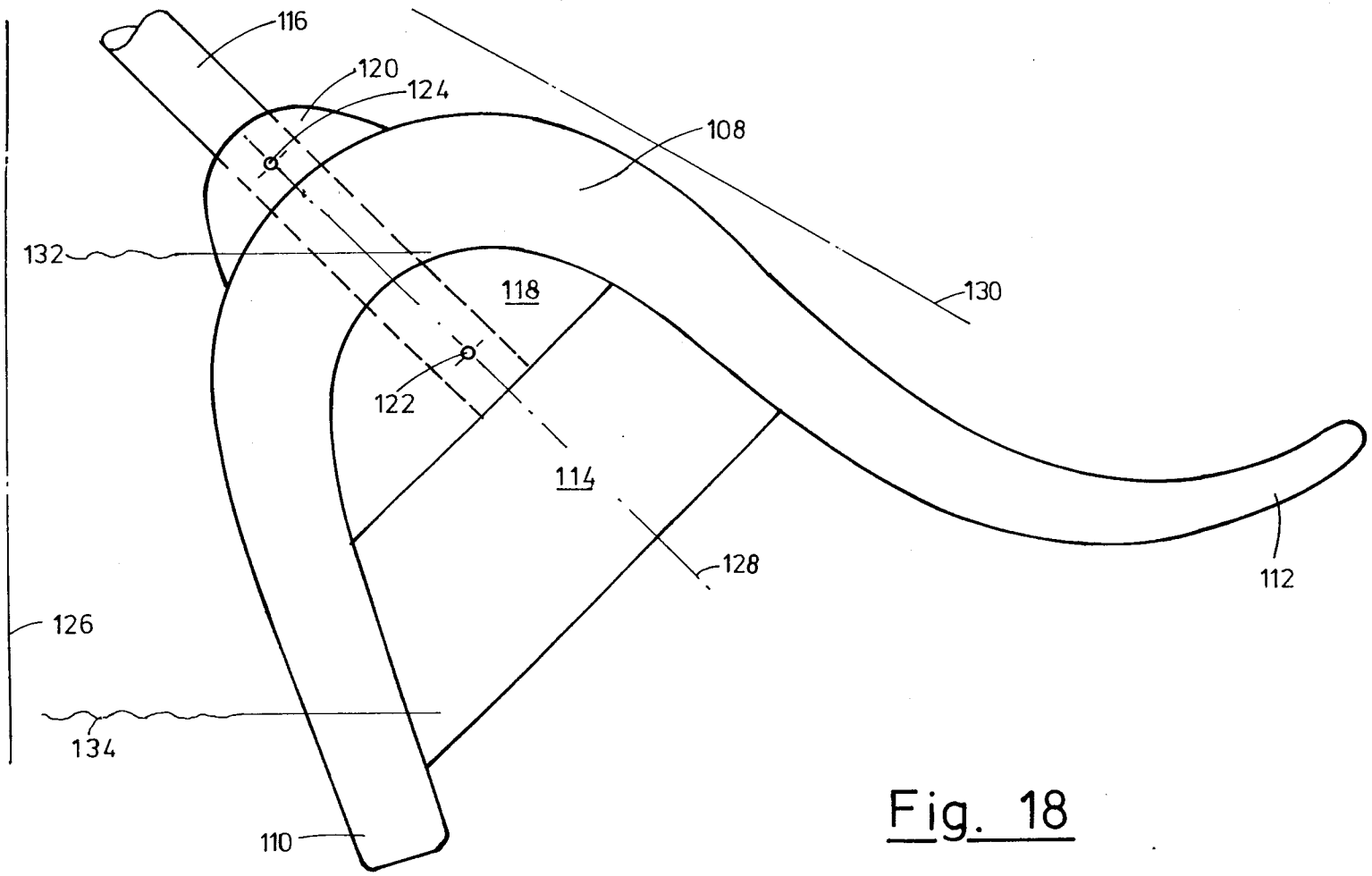
FIG. 18 is a side view of another exemplary embodiment of a paddle blade.

FIGS. 17 and 18 show front and side views of another exemplary embodiment of a propulsion paddle which can be powered manually or by foot. The shape is such that it can also operate without side rod guides. The blade 108 is divided into a front blade part 110 and a rear blade part 112. 114 is a guide. Blade 108 is mounted on a rod 116 which is connected by a rod holder part 118 and a rod clamp part 120 which attachment points 122 and 124 with the blade. The front insertion angle of the paddle is indicated at 126. The paddle is guided from this position through the middle position 128 into the rear position 130. 132 is the top water line and 134 is the bottom water line.

It is to be understood that numerous other modifications within the scope of the patent claims are possible as variations of the indicated and described exemplary embodiments.

I claim:

1. An elongate float to be used with another such float for walking on water, the two floats being arranged longitudinally in a side by side relationship such that the floats have inside edges facing one another and corresponding outside edges, each float comprising:

a foot holder for receiving a respective foot of a user, such foot holder being arranged in the float such that a mass distribution of the float is asymmetrical in a transverse direction to cause a greater buoyancy force between the inside edge and said foot holder than between the outside edge and said foot holder, when loaded by the user placing his foot in said foot holder.

2. A float as claimed in claim 1 and further including a top edge and at least one open cavity below the top edge.

3. A float as claimed in claim 2 and further including a check valve means in said top edge above said cavity for allowing air to flow from above said top edge into said cavity.

4. A float as claimed in claim 2 and further including opposed side guide parts, said side guide parts being vertically oriented and formed of a buoyant material, said side guide parts also being relatively narrow and extending longitudinally below said top edge such that said cavity is located therebetween.

5. A float as claimed in claim 4 and further including a front portion having a water engaging surface located between said side guide parts which is beveled downwardly and rearwardly, and a rear portion having a water engaging surface located between said side guide parts which is beveled downwardly and forwardly.

6. A float as claimed in claim 4 wherein said side guide parts include a bottom edge, and wherein said foot holder is mounted by a mounting means adjacent said bottom edge and between said side guide parts.

7. A float as claimed in claim 1 wherein said foot holder is adjustably mounted by said mounting means in the longitudinal direction.

8. A float as claimed in claim 1 and further including a top edge, two opposed side guide parts which are vertically oriented and formed of a buoyant material and which are relatively narrow and extend longitudinally below said top edge, a respective side part extending parallel to a respective side guide part adjacent a top thereof and forming a longitudinally periphery of the float, and connecting means for connecting said top edge, said side guide parts and said side parts together.

9. A float as claimed in claim 1 and further including a foot operated propulsion means for propelling the float through the water.

10. A float as claimed in claim 1 and further including a load operated propulsion means for propelling the float through the water by changing a load exterted on the float.

* * * * *